US008453589B2

(12) United States Patent
Czarnowski et al.

(10) Patent No.: US 8,453,589 B2
(45) Date of Patent: Jun. 4, 2013

(54) HATCH WITH COVER FOR BOATS

(75) Inventors: James Taylor Czarnowski, Encinitas, CA (US); Jason Christopher Kardas, Vista, CA (US); Gregory S. Ketterman, Vista, CA (US)

(73) Assignee: Hobie Cat Company, Oceanside, CA (US)

( * ) Notice: Subject to any disclaimer, the term of this patent is extended or adjusted under 35 U.S.C. 154(b) by 1000 days.

(21) Appl. No.: 11/888,826

(22) Filed: Aug. 1, 2007

(65) Prior Publication Data

US 2008/0029011 A1 Feb. 7, 2008

Related U.S. Application Data

(60) Provisional application No. 60/836,166, filed on Aug. 7, 2006.

(51) Int. Cl.
*B63B 19/14* (2006.01)

(52) U.S. Cl.
USPC ..... 114/201 R

(58) Field of Classification Search
USPC ..... 114/176, 178, 201 R, 203, 55.53, 114/255, 343, 364; 105/377.05, 377.07, 377.111, 377.11; 292/241, 240, 260, 256.5; 107/377.05, 377.07, 377.11; 220/315, 810, 220/324, 325
See application file for complete search history.

(56) References Cited

U.S. PATENT DOCUMENTS

| | | | | |
|---|---|---|---|---|
| 2,719,644 | A * | 10/1955 | Jurs | 220/244 |
| 4,647,093 | A * | 3/1987 | Palsson | 292/251 |
| 5,291,845 | A | 3/1994 | Vallery | |
| 5,358,291 | A | 10/1994 | Malmanger et al. | |
| 6,192,823 | B1 * | 2/2001 | Tsumiyama et al. | 114/363 |
| 6,460,902 | B1 * | 10/2002 | Kyle | 292/165 |
| 6,502,871 | B1 | 1/2003 | Malmanger | |
| 6,959,660 | B1 * | 11/2005 | Packebush | 114/55.53 |

FOREIGN PATENT DOCUMENTS

| | | | |
|---|---|---|---|
| DE | 33 45 960 | A1 * | 6/1984 |
| DE | 197 18 484 | A1 | 11/1998 |

* cited by examiner

*Primary Examiner* — Edwin Swinehart
(74) *Attorney, Agent, or Firm* — Joseph E. Mueth

(57) ABSTRACT

A novel hatch and with cover for boats comprising:
a hatch,
a hatch cover with handle hinged to said hatch, and
cooperating means on the hatch and cover including cam surfaces whereby the said handle can be rotated to secure the cover to the hatch.

10 Claims, 9 Drawing Sheets

HATCH WITH COVER FOR BOATS

This application claims the benefit of U.S. Provisional Patent Application Ser. No. 60/836,166, filed Aug. 7, 2006.

FIELD OF INVENTION

A deck plate or hatch is a common device for allowing access through the surface of a boat to an interior cavity. Deck plates or hatches typically provide for access to a storage area and when closed, are relatively water-tight barrier.

BACKGROUND OF INVENTION

Hatches are commonly incorporated into recreational boats, usually in openings in the upper hull areas adjacent to the seats, cockpit and the like. The hatches usually have an enclosed inner body for receiving things such as personal items, fishing accessories and the like.

Prior patents presently known are as follows:

1) U.S. Pat. No. 5,291,845
2) U.S. Pat. No. 6,502,871
3) U.S. Pat. No. 5,358,291

SUMMARY OF THE INVENTION

Briefly, this invention comprises a novel hatch and with cover for boats comprising:

a hatch, a hatch cover with handle hinged to said hatch, and cooperating means on the hatch and cover including cam surfaces whereby the said handle can be rotated to secure the cover to the hatch.

Further, this invention comprises a novel hatch and with cover for boats comprising:

a hatch, a hatch cover with handle hinged to said hatch, cooperating means on the hatch and cover including cam surfaces whereby the said handle can be rotated to secure the cover to the hatch, and a gear bucket with lid adapted to be carried by said hatch and securely held between said hatch cover and hatch.

Still further, this invention comprises a novel hatch and with cover for boats comprising:

a hatch, a hatch cover with handle hinged to said hatch, and cooperating means on the hatch and cover including cam surfaces whereby the said handle can be rotated to secure the cover to the hatch, said hatch cover having an annular sealing ring of generally triangular cross-section with the point of the triangle abutting an inner surface of the hatch to form a water tight seal.

More generally, the invention comprises a pleasure boat having in a convenient location at least one hatch with cover which includes:

a hatch, a hatch cover with handle hinged to said hatch, cooperating means on the hatch and cover including cam surfaces whereby the said handle can be rotated to secure the cover to the hatch, said hatch cover having an annular sealing ring of generally triangular cross-section with the point of the triangle abutting an inner surface of the hatch to form a water tight seal.

The combination of cork-screw cam, hinge opening, and elongated internal o-ring-type seal, as well as the optional gear bucket, makes for a hatch that different and more functional than other hatches.

The cork-screw cam allows the hatch to be only partially closed which requires little force and then, during the twisting of the handle, offers a mechanical advantage to draw the hatch completely closed. The hinge keeps the alignment between the cork-screw cam and the tab in which the cam engages.

The known internal o-ring seals are very water resistant but are typically dependent on accurate alignment between the lid and base of the hatch. Imperfections in plastic molding make close concentric alignment of the lid and hatch base not practical. Some areas of the lid are always closer to the base and the opposite side is always further away which makes common round o-rings not functional. According to this invention, a unique square-bottom with triangle-top rubber ring has been developed which easily deforms in the areas where the lid is too close to the base and yet still seals in the areas where the gap is larger. A flange is molded into the bottom of the hatch base which receives the "gear-bucket" which is essentially a round tackle box specifically designed to work with the hatch.

DESCRIPTION OF PREFERRED EMBODIMENTS

Figure 1:
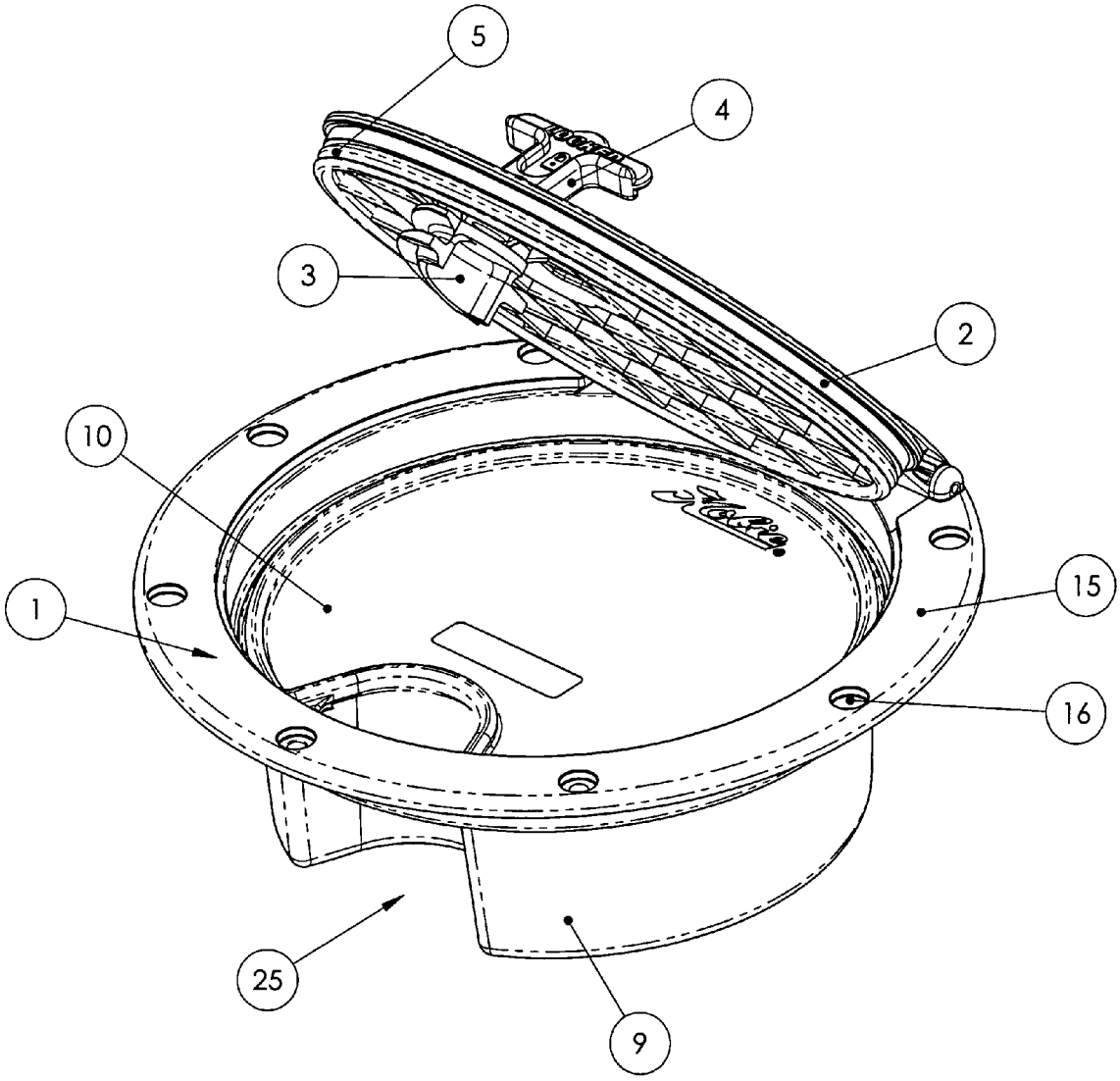
FIG. 1 shows a perspective view of the hatch with hatch cover, with the cover partially open and gear bucket in place.
Figure 2:
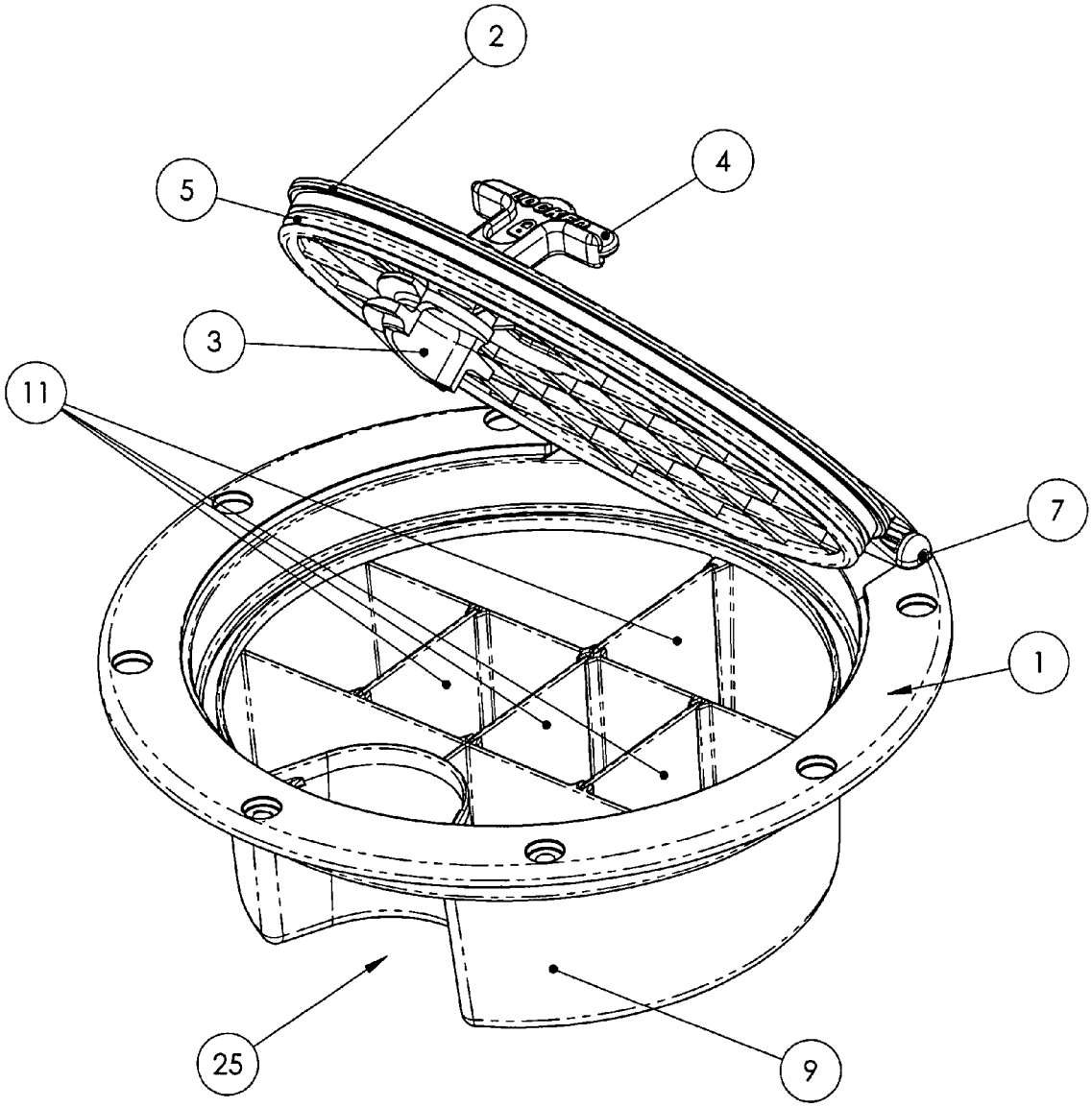
FIG. 2 shows the hatch cover as in FIG. 1 with the gear bucket in place and the interior of the gear bucket exposed.
Figure 3:
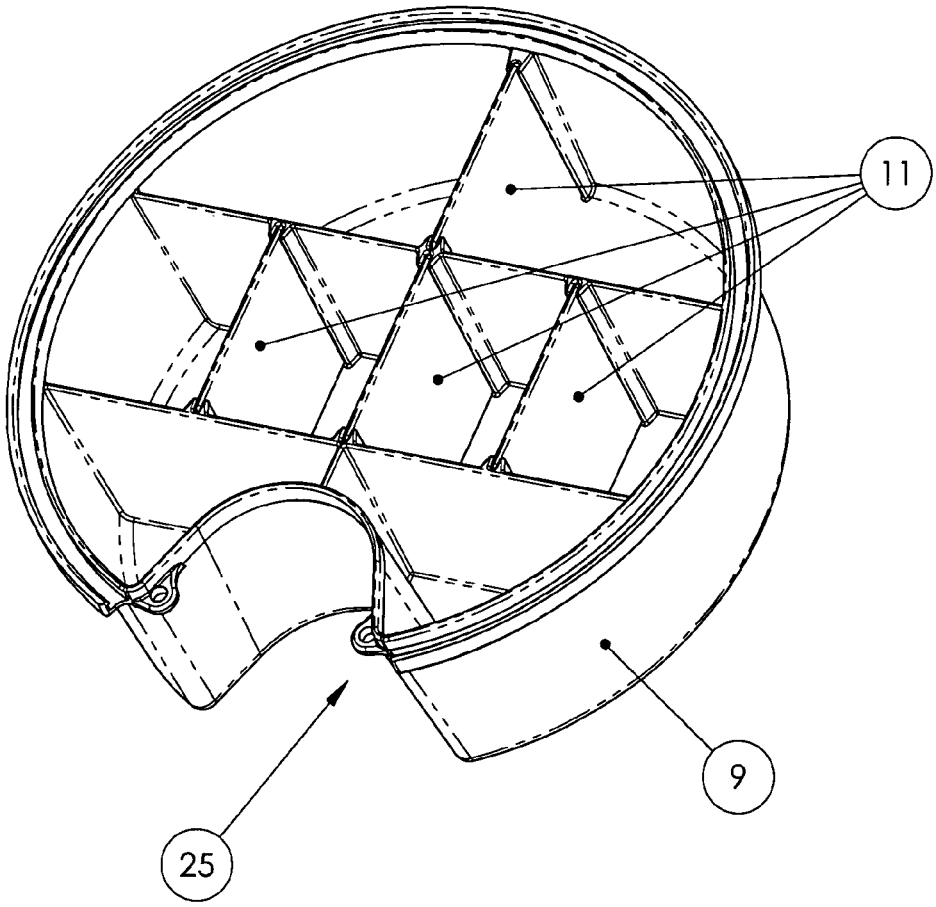
FIG. 3 is a perspective top view of the gear bucket with interior exposed.
Figure 4:
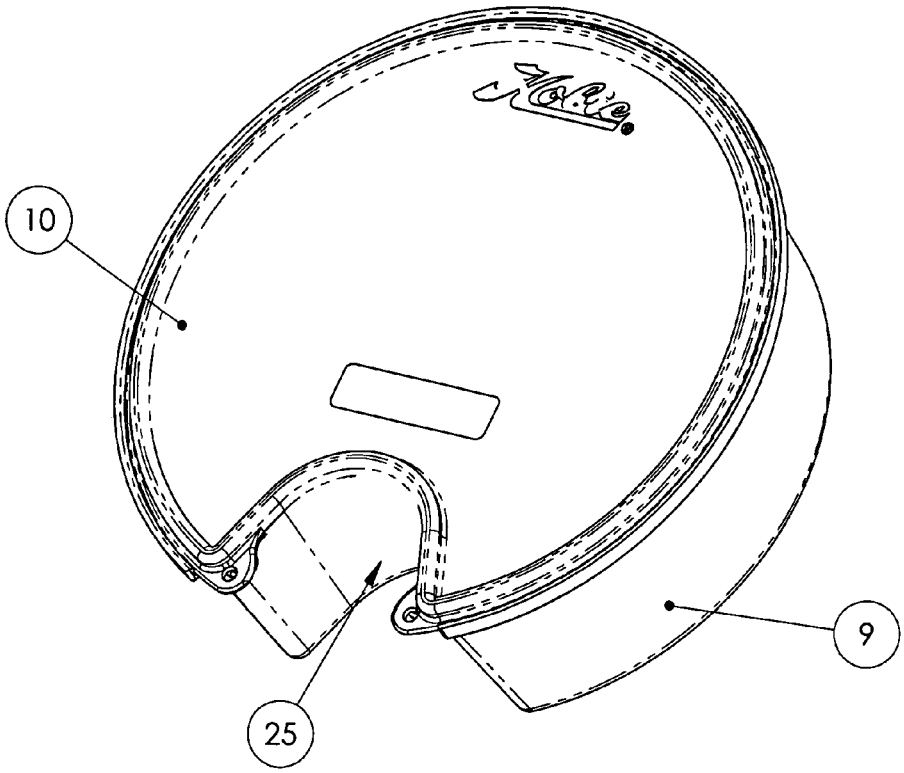
FIG. 4 shows the gear bucket with the gear bucket lid snapped into place.
Figure 5:
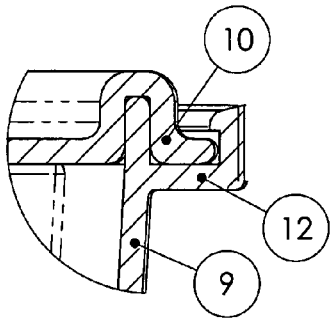
FIG. 5 is an enlarged sectional view showing the snap fit of the gear bucket cover to the gear bucket taken at C in FIG. 6.
Figure 6:
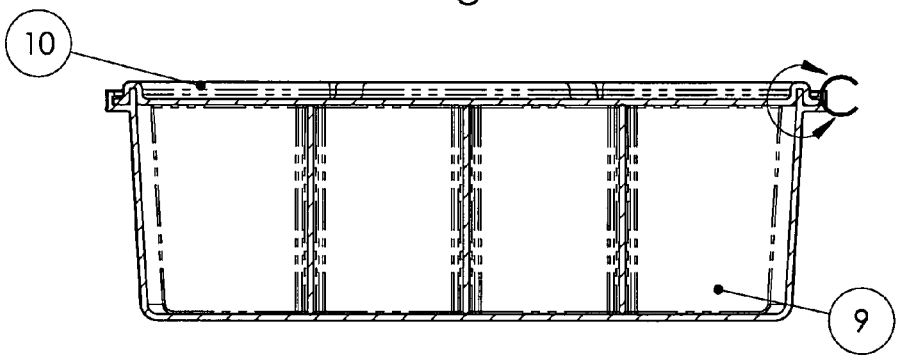
FIG. 6 is a side sectional view of the gear bucket.
Figure 7:
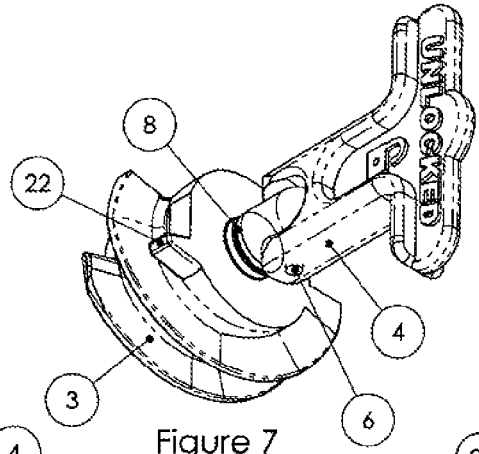
FIG. 7 is a perspective view of the hatch cover handle and cam surface mechanism.
Figure 10:
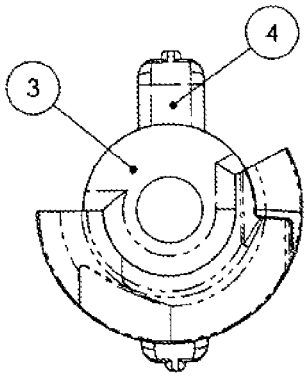
FIG. 10 is a bottom plan view of the structure of FIG. 7.
Figure 8:
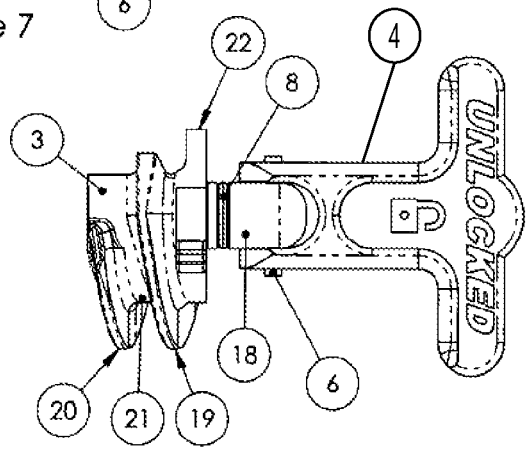
FIG. 8 is a front plan view of the structure of FIG. 7.
Figure 9:
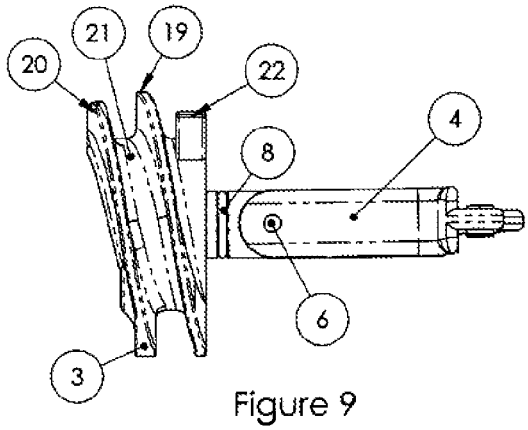
FIG. 9 is a side plan view of the structure of FIG. 7.
Figure 11:
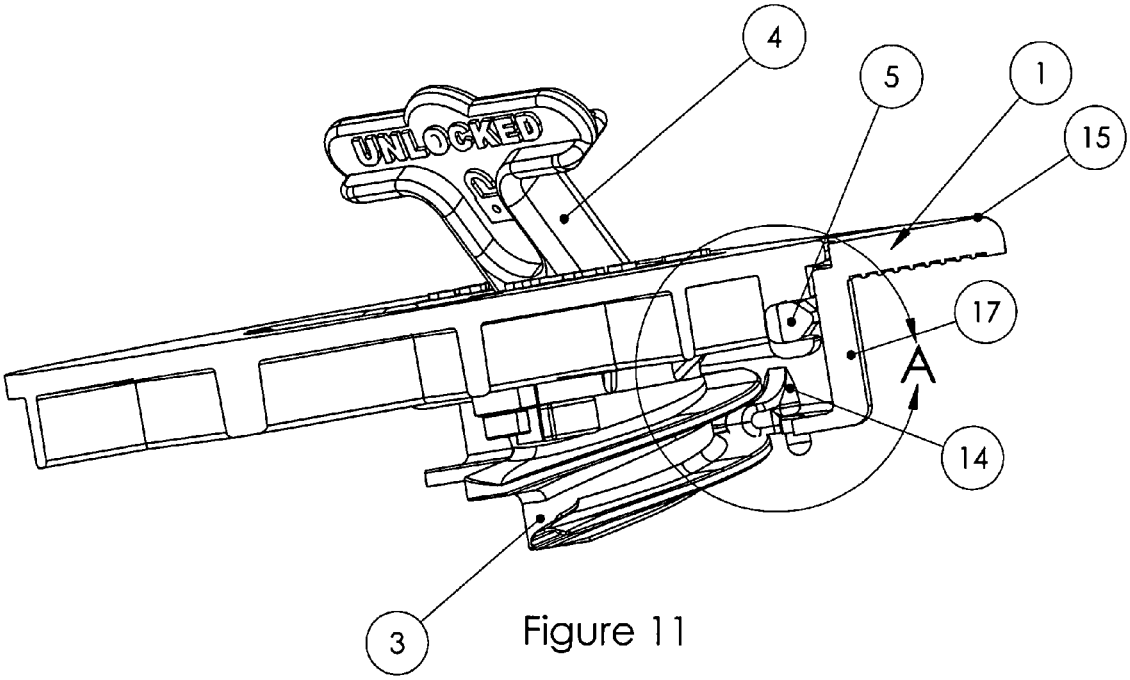
FIG. 11 is an enlarged partial view of the hatch, hatch cover, handle and cam mechanism in operation.
Figure 12:
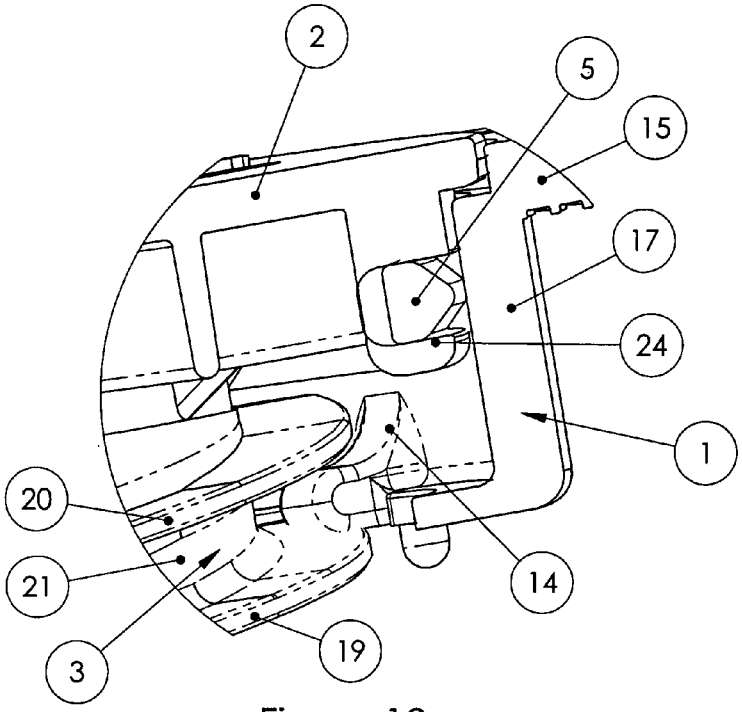
FIG. 12 is taken at A in FIG. 11.
Figure 13:
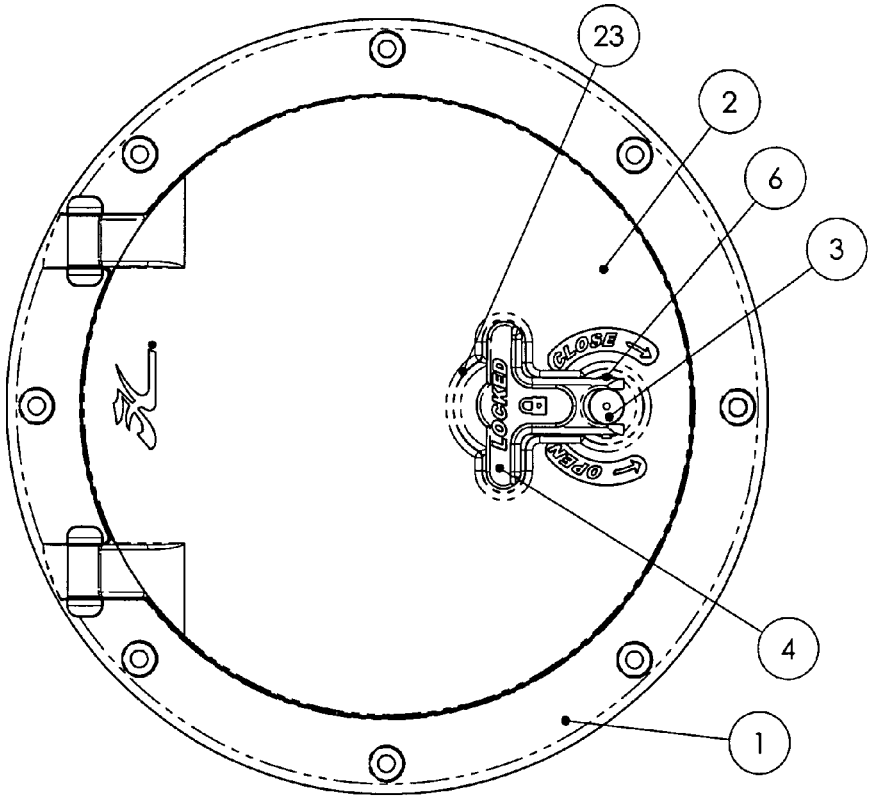
FIG. 13 is a top view of the hatch and hatch cover with the cover closed.
Figure 14:
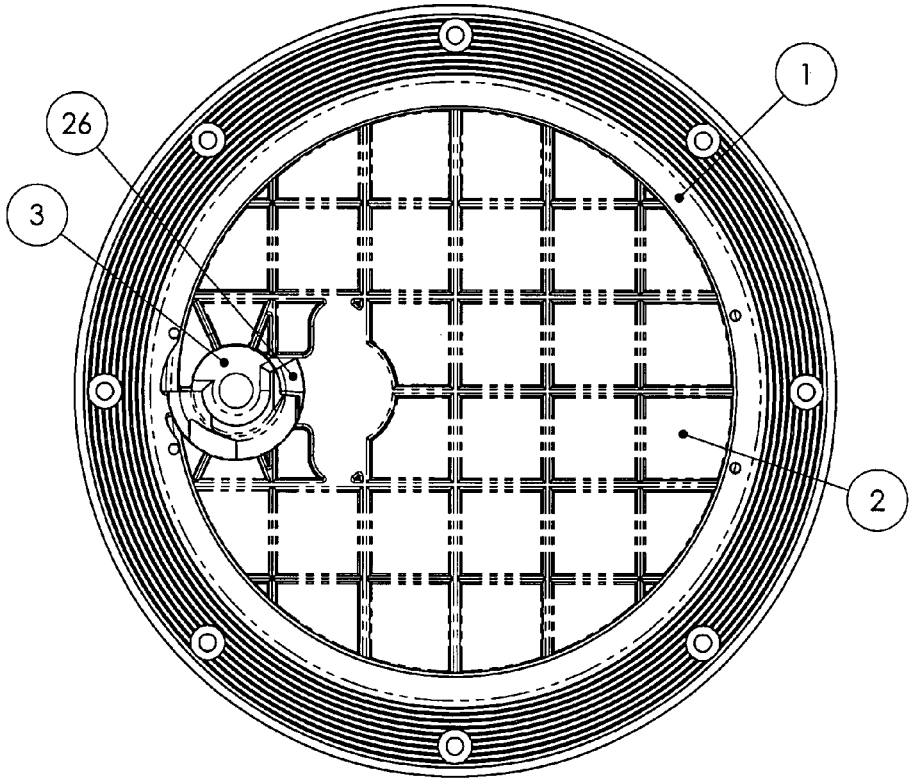
FIG. 14 is a bottom view of the hatch and cover of FIG. 13.
Figure 15:
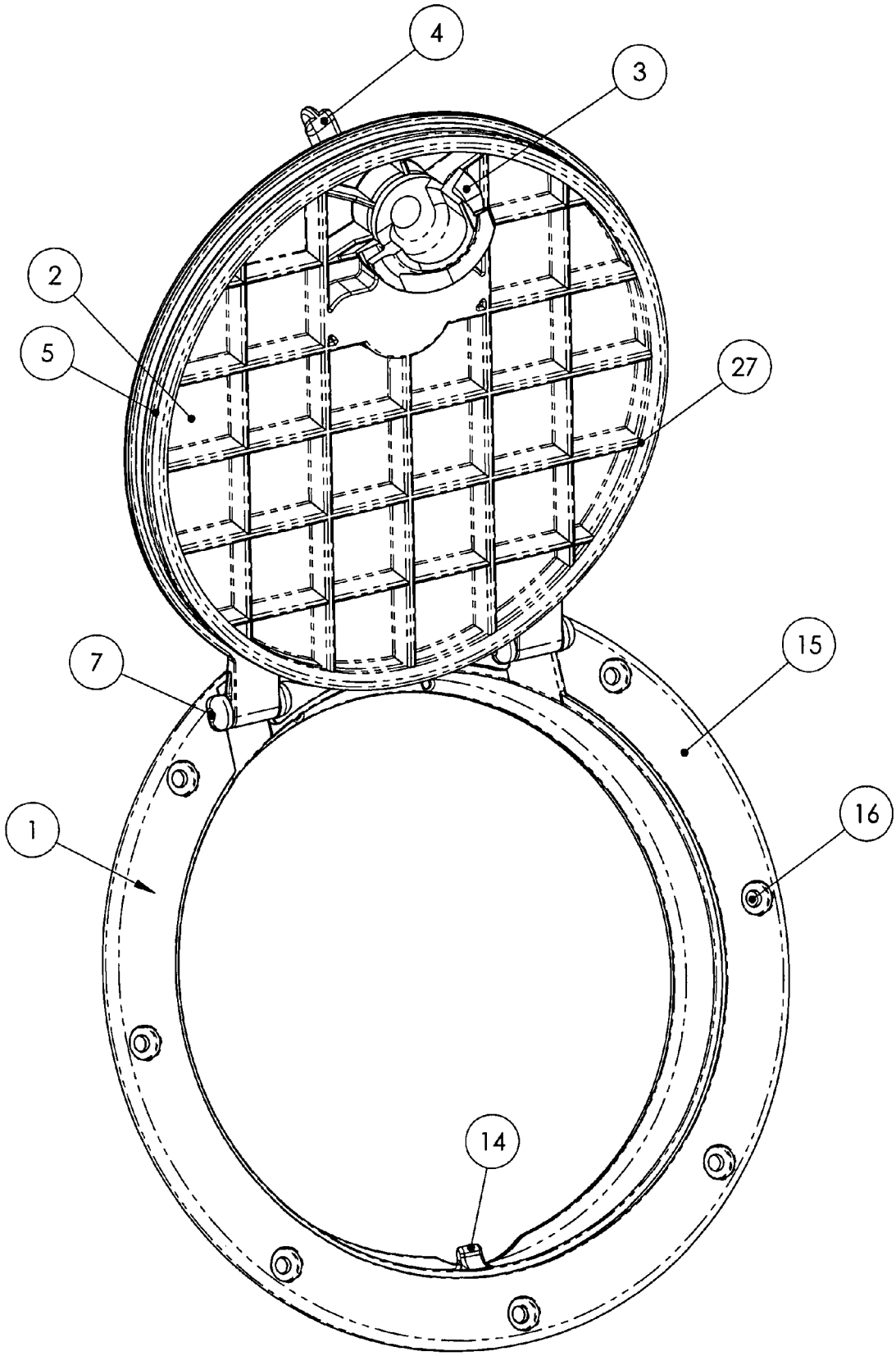
FIG. 15 is a perspective view of the top of the hatch and the underside of the hatch cover without the gear bucket in place.
Figure 16:
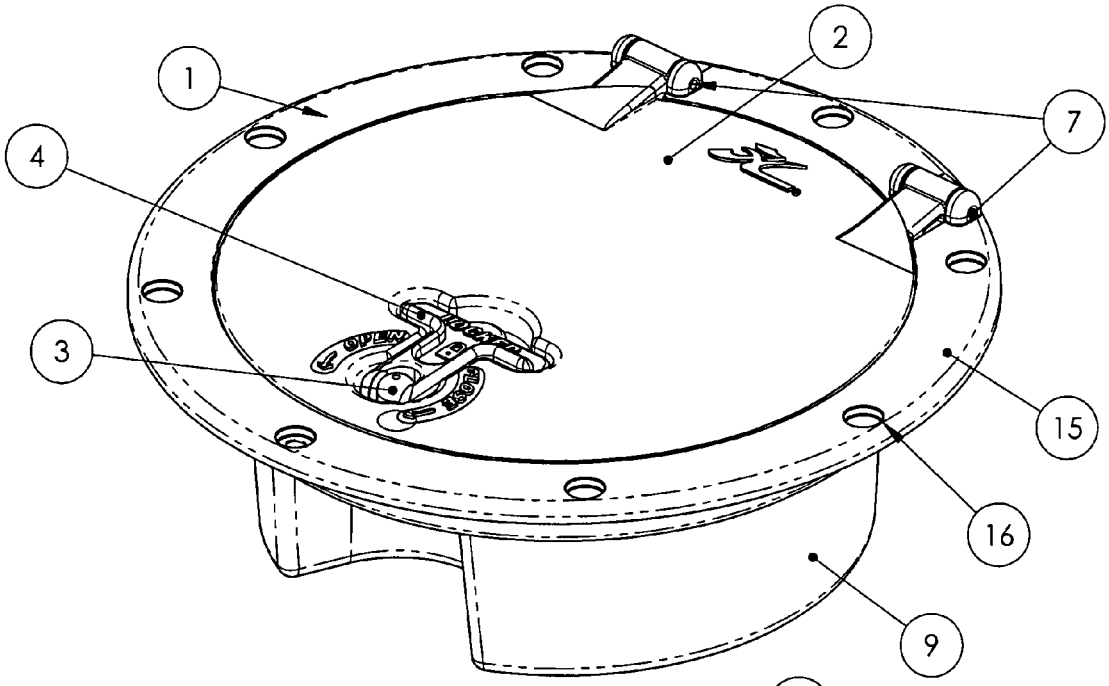
FIG. 16 is a perspective view of the hatch, hatch cover and gear bucket with the hatch cover closed and the gear bucket locked into place.
Figure 17:
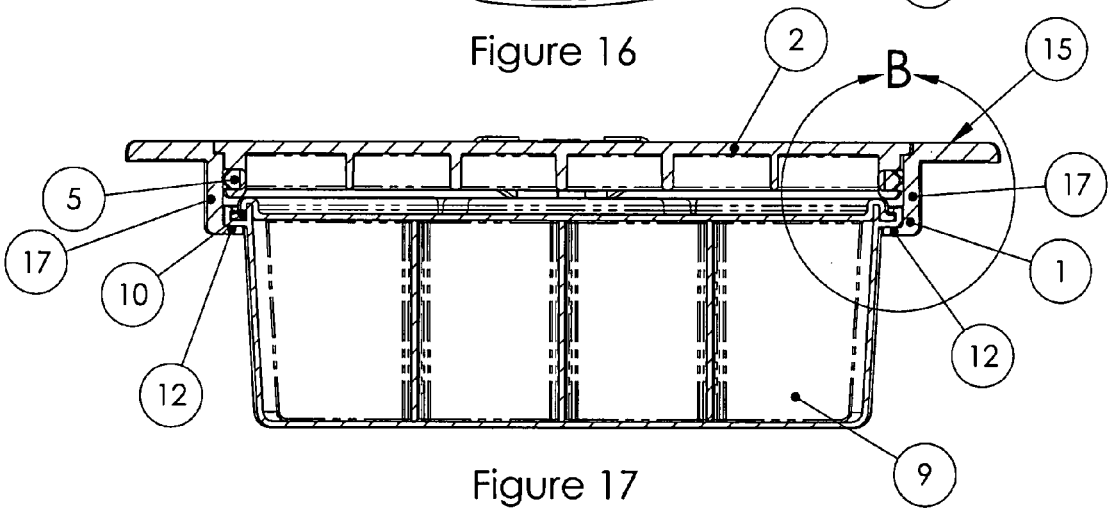
FIG. 17 is a side sectional view of the structure of FIG. 6.
Figure 18:
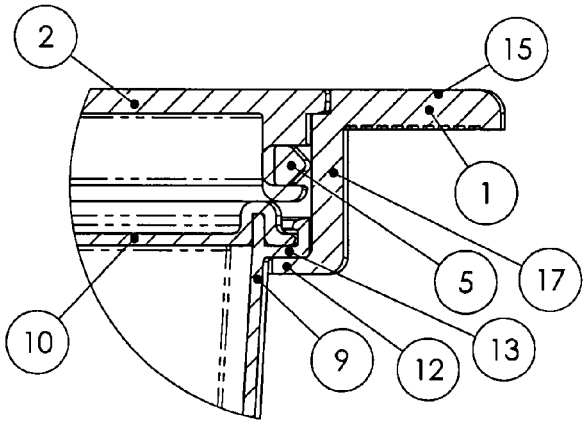
FIG. 18 is taken at B in FIG. 17.

The deck plate or hatch 1 has a flat upper ring 15 provided with screw holes or openings 16 to facilitate the attachment of the hatch 1 to a suitable surface of a boat, and a downwardly extending inner wall 17 which terminates in an annular inwardly extending ledge 12 at the lower extremity of wall 17

The hatch 1 has a hatch cover or lid 2 which is carried by hinges 7. The cover 2 fits snugly in ring 15, and when closed, is flush with ring 15.

The hatch cover 2 also has a handle 4 generally diametrically opposed the hinged side of hatch cover 2 which is carried by a pivot pin 6 fixed to cam surface carrier 18. The cam surface carrier 18 passes through hole 8 in cover 2. The cam surface 3 itself comprises spiral-like side walls 19 and 20 with the depression 21 therebetween, forming a race in which engages tab 14. When handle 4 is rotated about its vertical axis with cover 2 laid down on hatch 1, cam surface carrier 18 also rotates causing cam surface 3 to rotate and engage tab 14. As handle 4 is further rotated, tab 14 travels in depression 21 between walls 19 and 20. This gradually causes the cover 2 to snugly close onto hatch 1. This travel is limited to one-half turn of the handle 4 by stop 22 which comes into abutting contact with pin 26 formed in the underside of hatch lid 2 when cover 2 is fully closed.

When not in use, handle 4 is received in recess 23 in hatch cover 2 and when in the stowed position is essentially flush with the upper surface of cover 2.

Hatch lid 2 has an annular flexible rubber ring 5 providing a water tight seal of the cover 2 with the hatch 1. The ring or seal 5 is of a generally triangular cross section with the pointed end pressing against and sealing on the inside surface of wall 17. The seal 5 is carried in annular groove 24.

Optionally, the novel hatch 1 with cover 2 may carry a generally cylindrical gear bucket 9 with lid 10 having a series of compartments 11 for carrying miscellaneous personal articles and/or fishing accessories, and the like. Typically, the gear bucket may be thought of as a cylindrical tackle box. The gear bucket 9 and lid 10 are generally made of a somewhat flexible plastic so that the two parts snap together in a typical Tupperware fashion (Tupperware is a registered trademark of Dart Industries, Inc., Orlando, Fla.). The gear bucket 9 and lid 10 each have a cutout 25 to accommodate the cam surface mechanism described above.

The gear bucket 9 with lid 10 can be easily inserted in hatch 1 when hatch lid 2 is open.

The gear bucket 9 has an annular lip 13 which rests on ledge 12 at the lower extremity of wall 17 of hatch 1. When the lid 2 on hatch 1 is closed, the annular lip 13 of gear bucket 9 is tightly compressed between ledge 12 and the bottom edge or surface 27 of lid 2 so that the bucket 9 is prevented from moving. When lid 2 is opened, the gear bucket 9 with its lid 10 can, if desired, be readily lifted out of the hatch.

The invention claimed is:

1. A hatch with cover for boats comprising:
a hatch,
a hatch cover with handle hinged to said hatch,
cooperating means on the hatch and cover including cam surfaces whereby the said handle can be rotated to secure the cover to the hatch, and
a gear bucket with lid adapted to be carried by said hatch and securely held between said hatch cover and hatch,
said gear bucket and lid each having a cutout to accommodate said cam surfaces.

2. The hatch of claim 1 wherein said hatch has an internal ledge and said gear bucket has an annular lip which rests on said ledge, said gear bucket and lid being received in said hatch.

3. The hatch of claim 1 wherein said handle is generally attached to said cover at a point diametrically opposed the hinge side of said cover.

4. The hatch of claim 1 wherein said handle engages a cam surface carrier present on the side of said cover opposite the side carrying said handle, said cam surface carrier carrying a cam surface, the interior of said hatch having a tab, whereby when said handle is rotated about its vertical axis with said hatch cover laid down on said hatch, said cam surface carrier also rotates, causing said cam surface to rotate and engage said tab, gradually causing said hatch cover to snugly close onto said hatch.

5. The hatch of claim 4 wherein said cam surface comprises spiral side walls providing a depression therebetween forming a race which engages said tab.

6. A pleasure boat having in a convenient location at least one hatch with cover which comprises:
a hatch,
a hatch cover with handle hinged to said hatch,
cooperating means on the hatch and cover including cam surfaces whereby the said handle can be rotated to secure the cover to the hatch, and
a gear bucket with lid adapted to be carried by said hatch and securely held between said hatch cover and hatch,
said gear bucket and lid each having a cutout to accommodate said cam surfaces.

7. A hatch with cover for boats comprising:
a hatch,
a hatch cover with handle hinged to said hatch,
cooperating means on the hatch and cover including cam surfaces whereby the said handle can be rotated to secure the cover to the hatch, and
a gear bucket with lid adapted to be carried by said hatch and securely held between said hatch cover and hatch,
said gear bucket and lid each having a cutout to accommodate said cam surfaces,
said hatch cover having an annular sealing ring of generally triangular cross-section with the point of the triangle abutting the surface of the hatch to form a water-tight seal.

8. A pleasure boat having in a convenient location at least one hatch with cover which comprises:
a hatch,
a hatch cover with handle hinged to said hatch,
cooperating means on the hatch and cover including cam surfaces whereby the said handle can be rotated to secure the cover to the hatch, and
a gear bucket with lid adapted to be carried by said hatch and securely held between said hatch cover and hatch,
said gear bucket and lid each having a cutout to accommodate said cam surfaces,
said hatch cover having an annular sealing ring of generally triangular cross-section with the point of the triangle abutting an inner surface of the hatch to form a water tight seal.

9. A hatch with cover for boats comprising:
a hatch,
a hatch cover with handle, and
cooperating means on the hatch and cover including a cam surface whereby the said handle can be rotated to secure the cover to the hatch,
wherein said handle engages a cam surface carrier extending on the side of said cover opposite the side carrying said handle, said cam surface carrier passing through said cover, said cover otherwise being imperforate, said cam surface carrier carrying a cam surface comprising spiral side walls providing a depression therebetween forming a race, the interior of said hatch having a tab, whereby when said handle is rotated about its vertical axis with said hatch cover laid down on said hatch, said cam surface carrier also rotates, causing said cam surface to rotate and engage said tab, gradually causing said hatch cover to snugly close onto said hatch.

10. A pleasure boat having at a convenient location at least one hatch with cover which comprises:
a hatch,
a hatch cover with handle, and cooperating means on the hatch and cover including a cam surface whereby the said handle can be rotated to secure the cover to the hatch, wherein said handle engages a cam surface carrier extending on the side of said cover opposite the side carrying said handle, said cam surface carrier passing through said cover, said cover being otherwise imperforate, said cam surface carrier carrying a cam surface comprising spiral side walls providing a depression therebetween forming a race, the interior of said hatch having a tab, whereby when said handle is rotated about its vertical axis with said hatch cover laid down on said hatch, said cam surface carrier also rotates, causing said cam surface to rotate and engage said tab, gradually causing said hatch cover to snugly close onto said hatch said hatch cover having an annular sealing ring of generally triangular cross-section with the point of the triangle abutting the surface of the hatch to form a water-tight seal.

* * * * *